US006571537B2

(12) United States Patent
Ghirlandi

(10) Patent No.: US 6,571,537 B2
(45) Date of Patent: Jun. 3, 2003

(54) METHOD AND DEVICE FOR REJECTING INFUSION BAGS IN MANUFACTURING MACHINE

(75) Inventor: Dante Ghirlandi, Bologna (IT)

(73) Assignee: I.M.A. Industria Macchine Automatiche S.p.A., Bologna (IT)

( * ) Notice: Subject to any disclaimer, the term of this patent is extended or adjusted under 35 U.S.C. 154(b) by 120 days.

(21) Appl. No.: 09/926,371

(22) PCT Filed: Feb. 19, 2001

(86) PCT No.: PCT/IB01/00216

§ 371 (c)(1),
(2), (4) Date: Oct. 22, 2001

(87) PCT Pub. No.: WO01/62599

PCT Pub. Date: Aug. 30, 2001

(65) Prior Publication Data

US 2002/0139086 A1 Oct. 3, 2002

(30) Foreign Application Priority Data

Feb. 22, 2000 (IT) ..... BO2000A0081

(51) Int. Cl.[7] ..... B65B 61/14; B65B 57/02

(52) U.S. Cl. ..... 53/413; 53/53; 53/65; 53/134.2

(58) Field of Search ..... 53/53, 54, 55, 53/65, 134.2, 413, 447, 450, 452

(56) References Cited

U.S. PATENT DOCUMENTS

| | | | | |
|---|---|---|---|---|
| 3,805,483 A | | 4/1974 | Romagnoli | |
| 3,939,984 A | * | 2/1976 | Butner et al. | 53/53 |
| 4,738,073 A | * | 4/1988 | Mattei et al. | 53/53 |
| 4,829,742 A | * | 5/1989 | Romagnoli | 53/134.2 |
| 4,885,896 A | * | 12/1989 | Romagnoli | 53/134.2 |
| 5,383,322 A | * | 1/1995 | Collins et al. | 53/53 |
| 5,412,926 A | * | 5/1995 | Focke | 53/53 |
| 5,527,419 A | * | 6/1996 | Vernon et al. | 53/134.2 |
| 5,689,936 A | * | 11/1997 | Kenney | 53/134.2 |
| 5,802,820 A | * | 9/1998 | Romagnoli | 53/134.2 |
| 5,870,880 A | * | 2/1999 | Romagnoli | 53/134.2 |

FOREIGN PATENT DOCUMENTS

EP 0 806 353 A1 11/1997

* cited by examiner

*Primary Examiner*—John Sipos
*Assistant Examiner*—Louis Huynh
(74) *Attorney, Agent, or Firm*—Arent Fox Kintner Plotkin & Kahn, PLLC

(57) ABSTRACT

A method and a device for rejecting a defective filter bag for infusion products in a manufacturing machine are disclosed. When a defect or fault in the filter bag is detected by sensors while the filter bag is being completed, the end portion of the defective filter bag is deformed out of the reach of the intermediate pick-up station by the deformer so as to prevent the defective filter bag from being picked up and transferred to the subsequent stacking station and the defective filter bag is then expelled by the expeller.

9 Claims, 4 Drawing Sheets

METHOD AND DEVICE FOR REJECTING INFUSION BAGS IN MANUFACTURING MACHINE

TECHNICAL FIELD

The present invention relates to a method for rejecting a filter bag for infusion products and the device that implements said method and that forms part of a machine producing filter bags.

BACKGROUND ART

Machines producing filter bags generally comprise a plurality of work stations, installed in sequence along the respective production lines where the filter bags are completed, each containing a charge of the product sealed in a corresponding section or chamber in the filter bag. Either single or double-chamber filter bags can be used, depending on the type of product and machine model; a connecting string is attached to the filter bag, adopting a number of alternative known methods (by knotting, heat sealing or by means of a heat sealed stamp, for example) and a pick-up tag is attached to the free end of the string, using a number of alternative known methods (by knotting, heat sealing or by means of a heat sealed stamp, for example).

The string and pick-up tag are positioned on the filter bag (for example, by winding the string around the bag and attaching it to or tucking it inside the bag) to complete a product ready for grouping and stacking in a filter bag stacking station, followed by a final packaging step, comprising the packaging of the filter bag stacks or groups of stacks in cartons or boxes.

Before moving on to the stacking step described above, each filter bag is generally individually wrapped, using a sheet of overwrapping paper suitably folded into a U shape over itself to enclose the filter bag and sealed in one of two different ways: along at least two longitudinal sides or edges of the overwrapping paper sheet if the sheet has an opening flap folded over onto its surface; or sealed simultaneously along three edges of the sheet, namely two longitudinal edges and the upper transversal edge, if a simplified type of overwrapping without flap is being made.

At present, the manufacturing of each filter bag and the application of the string and tag is controlled and checked along the path followed by the filter bag by sensors installed in the above-mentioned work stations.

These sensors are designed to detect the presence of any defects or faults in the filter bags, for example, if the bag is not properly sealed, and/or has not been filled with an adequate quantity of the infusion product, and/or the pick-up tag and/or connecting string have not been attached or have been attached incorrectly, etc. The sensors then send an error signal to the control unit installed in the manufacturing machine.

When a rejection signal is given by the control unit in the manufacturing machines currently in use, a bag cannot be rejected until the step of packing the filter bag stacks in boxes has been completed.

In other words, when a single defective filter bag is detected, the entire box or carton containing one or more stacks of filter bags has to be rejected. Moreover, in many cases, this operation has to be carried out by hand.

Up to now, it has not been possible to modify the structure of the manufacturing machine in such a way that bags can be rejected automatically prior to the packaging step, without greatly increasing the structural complexity of the machine as a whole.

The aim of the present invention is therefore to eliminate the above mentioned problem through a method for rejecting an individual defective filter bag, and the related device implementing the method, prior to the above-mentioned packaging step, without altering the traditional structure of the manufacturing machine.

DISCLOSURE OF THE INVENTION

Accordingly, the present invention provides a method for rejecting a filter bag for infusion products in a manufacturing machine, said method comprising a step of feeding the filter bag along a production line to a plurality of work stations, installed in sequence along the line, where the filter bag is completed by attaching a connecting string and pick-up tag; a step of detecting and inspecting the filter bag as it is being completed; and a step of feeding the filter bag towards an intermediate station where it is picked up and transferred to a subsequent stacking station for the forming of stacks of a preset plurality of filter bags. The method is characterised in that it comprises a step of disabling the feed motion of the defective filter bag towards the pick-up station when a defect or fault is detected in the filter bag, and a step of rejecting and expelling the defective filter bag.

The present invention also provides a device for rejecting filter bags for infusion products installed in manufacturing machines, the filter bags comprising at least one chamber containing a charge of the product and a string joining at least one chamber to a pick-up tag, each attached to one end of the string; the device comprising handling means for moving the filter bags along a production line where at least the following are installed in sequence: a station for attaching the string to the filter bag; a station for attaching the pick-up tag to the string and positioning the string and pick-up tag on the filter bag; an intermediate station for picking up the completed filter bag and transferring it to a stacking station where stacks are formed with a set number of filter bags; sensors installed at least in the string and pick-up tag attachment stations for detecting and inspecting the filter bag and sending an error signal to the control unit if the filter bag is defective. The device is characterised in that it also comprises means for disabling the feeding of the defective filter bag, installed and operating in the proximity of the handling means and designed to prevent the defective filter bag from being transferred from the handling means to the intermediate pick-up station; and means for expelling the defective filter bag from the handling means.

BRIEF DESCRIPTION OF THE DRAWINGS

The technical characteristics of the invention, with reference to the above aims, are clearly described in the claims below and its advantages are apparent from the detailed description which follows, with reference to the accompanying drawings which illustrate an embodiment of the invention intended merely by way of example without restricting the scope of the inventive concept, and in which:

DETAILED DESCRIPTION OF THE PREFERRED EMBODIMENT

Figure 1:
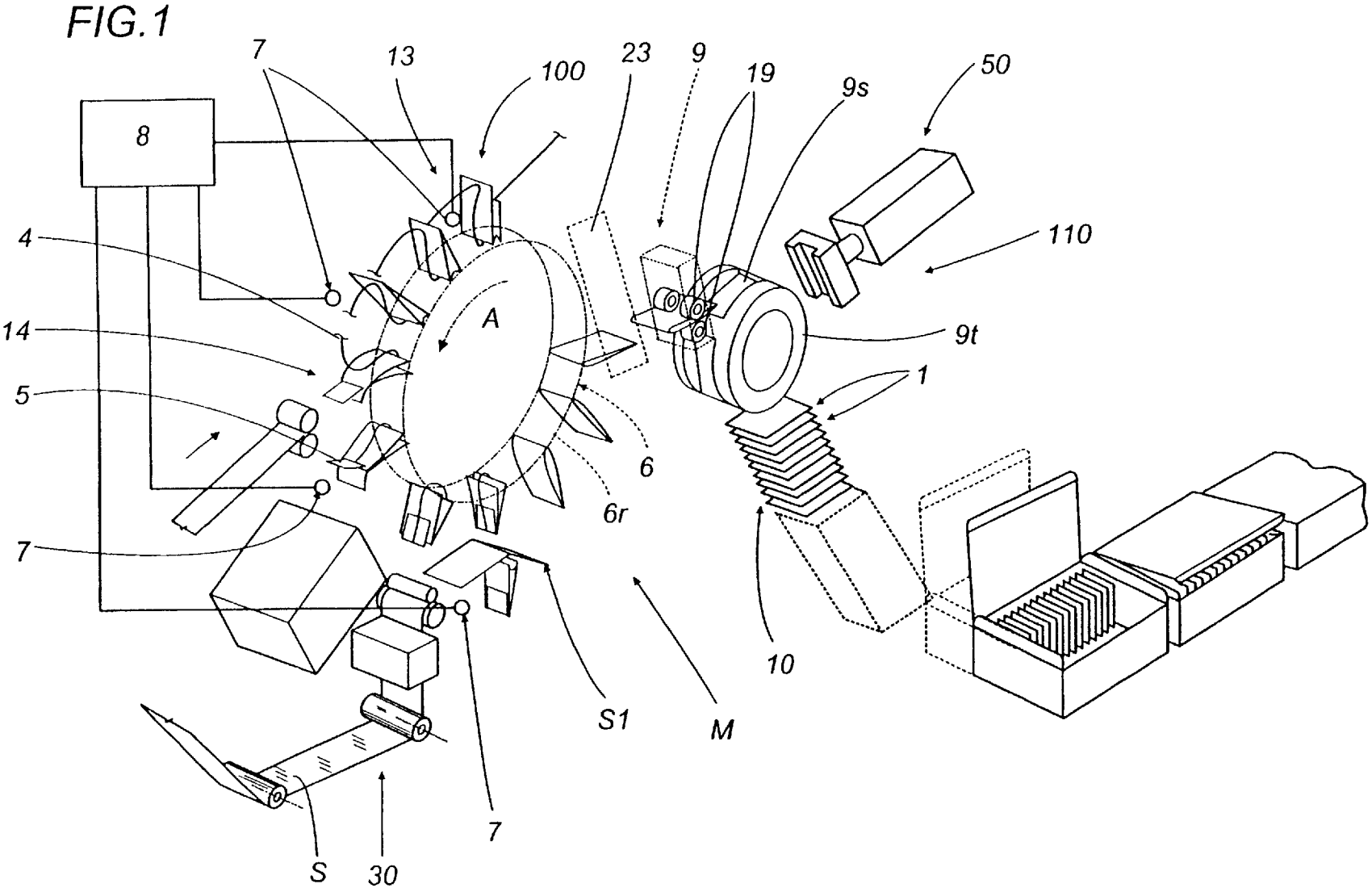
FIG. 1 is a schematic perspective view of a machine for the manufacturing of filter bags for infusion products equipped with the device for rejecting filter bags that implements the method according to the present invention.
Figure 2:
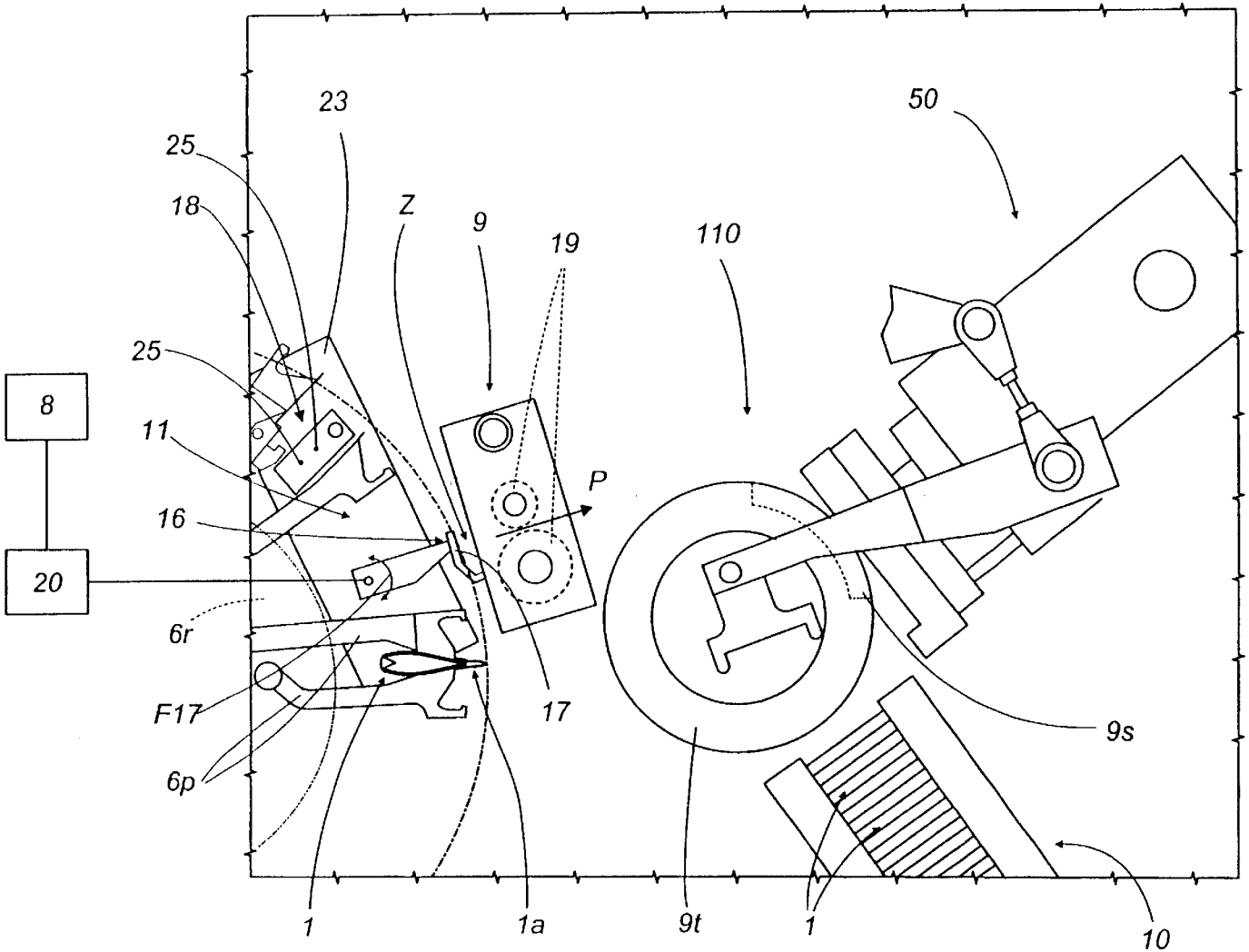
FIG. 2 is a schematic front view, with some parts cut away in order to better illustrate others, of an area of the machine illustrated in FIG. 1 implementing the rejecting method according to the present invention.
Figure 7:
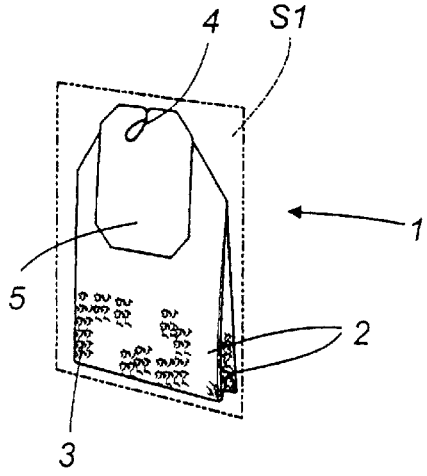
FIG. 7 is a schematic perspective view of a filter bag made by the machine illustrated in FIG. 1.

With reference to the accompanying drawings and in particular FIGS. 1, 2 and 7, the aim of the present method is to reject individual filter bags for infusion products.

The filter bags, denoted in their entirety in FIG. 7 by the numeral 1, comprise one or more chambers 2 each containing a charge 3 of infusion product, and a string 4 connecting the chamber or chambers 2 to a pick-up tag 5, which is attached to the other end of the string 4.

The present method comprises the following steps (see FIG. 1) which are effected at the end of the production process in the filter bag 1 manufacturing machine M: feeding each filter bag 1 along a production line A using handling means 6 (described in further detail below) for moving the filter bags 1 to and from a plurality of work stations, installed in sequence along the production line A where the filter bag 1 is completed and the string 4 and pick-up tag 5 are attached around the filter bag 1; the filter bags 1 are checked constantly along the production line A while they are being completed, by sensors 7 connected to a control unit 8, in such a way that, if a defective filter bag 1 is detected by the sensors 7 or, for example, the filter bag 1 has not been filled with an adequate charge 3 of infusion product and/or the filter bag 1 has not been sealed correctly, and/or the pick-up tag 5 and/or connecting string 4 have not been attached or either of them has not been correctly attached to the filter bag 1, the feeding of the defective filter bag 1 is disabled, that is to say, there is an operating step in which the defective filter bag 1 is prevented from moving forward to the intermediate pick-up station 9 and the filter bag 1 is prevented from being transferred to a stacking station 10 (see detail in FIGS. 4 and 5); this is followed, finally, by a step of expelling the defective filter bag 1 from the handling means 6 (see FIG. 6) installed in the machine M.

More specifically, as explained in further detail below, the step of disabling the forward movement of the defective filter bag 1 is effected in the proximity of the intermediate pick-up and transfer station 9 by deforming or folding at least one portion 1*a* of the edge of the filter bag 1 protruding from the handling means 6 (see FIGS. 3 to 5); and the step of expelling the defective filter bag 1 is effected during the step described, in a direction B transversal to the vertical plane in which the production line A extends and towards a defective filter bag 1 collection station 12.

The method according to the invention as described above is implemented by a device 100, forming part of the manufacturing machine M (see FIG. 1) and comprising the handling means 6 which move individual filter bags 1 along the production line A.

As illustrated in FIGS. 2 to 6, said handling means 6 comprise a plurality of grippers 6*p* which are designed to pick up and feed individual filter bags 1 and which are radially mounted on a starwheel 6*r*.

Figure 3:
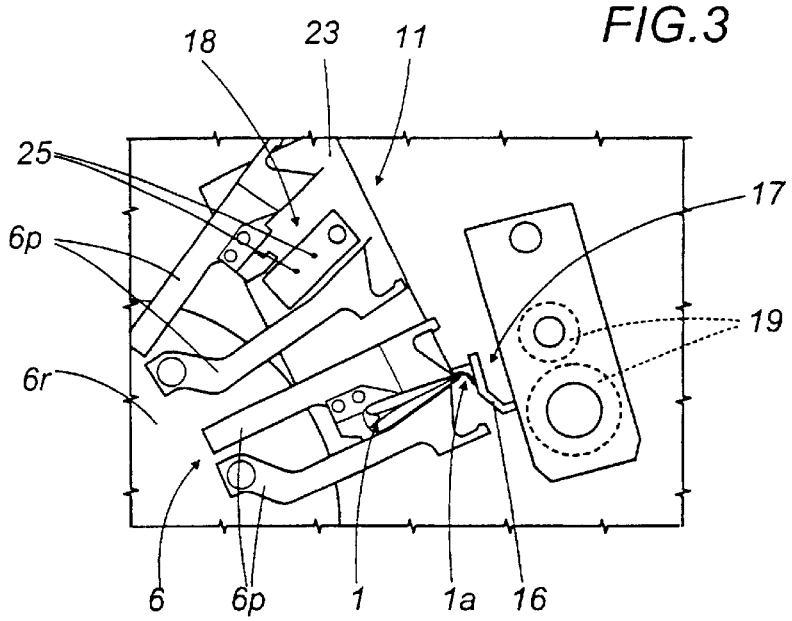
FIG. 3 is a schematic front view, with some parts cut away in order to better illustrate others, of the rejecting device according to the present invention, with reference to FIG. 2.

These grippers 6*p* convey the individual filter bags 1 to a series of work stations, installed in sequence along the production line A, comprising, as shown in FIGS. 1, 2 and 3, a station 13 where the string 4 is joined to the filter bag 1, a station 14 where the pick-up tag 5 is attached to the string 4 and said string 4 and pick-up tag 5 are positioned on the filter bag 1, an intermediate station 9 where the completed filter bag 1 is picked up and transferred to a stacking station 10, where the filter bags 1 are grouped, using a known method, to form stacks of filter bags 1.

As illustrated in FIG. 1, the manufacturing machine M also comprises a station 30 for feeding a web of overwrapping paper S cut into individual paper sheets; each sheet is doubled over into a U shape, according to a known method which is not described, so as to enclose a filter bag 1 and thereby create an outer envelope S1 (see FIG. 7) around the filter bag 1; the longitudinal edges of each outer envelope S1 are sealed, according to a known method which is not described, in a sealing station 110, through known reciprocating means 50, preferably sealing means.

As illustrated in FIG. 2, the intermediate pick-up and transfer station 9 comprises a drum 9*t* which has recesses 9*s* for receiving the filter bags 1, and a pair of rollers 19, mounted to face each other, which are designed to pick up the filter bags 1 in sequence from the grippers 6*p* in an area Z and to feed said filter bags 1 in a direction P radial to the vertical plane in which the production line A extends.

In particular, the drum 9*t* also acts as a stop for the reciprocating means 50 for sealing the longitudinal edges of the outer envelope S1.

As illustrated in FIG. 1, at least the stations 13, 14 and 30 have sensors 7, for example optic sensors 7, designed to detect the presence of any fault or defect, for example, if the filter bag 1 has not been filled with an adequate quantity of the infusion product, and/or the filter bag 1 is not properly sealed, the tag 5 and connecting string 4 have not been attached or have been attached incorrectly, the sheet of overwrapping paper S to be wrapped over to enclose the filter bag 1 has not been fed correctly, and to send an error signal to the control unit 8.

As illustrated in FIG. 2, means 11 for disabling the forward movement of the defective filter bags 1 are mounted in the area Z, near the pair of rollers 19. Said means 11 are designed to prevent the defective filter bag 1 from being fed from the grippers 6*p* to the pair of rollers 19 in the intermediate station 9.

Figure 4:
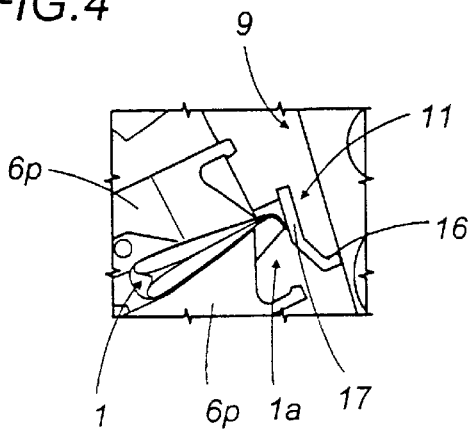
FIG. 4 is a schematic partial side view of a detail of the device illustrated in FIGS. 2 and 3 during one of its operating steps.
Figure 5:
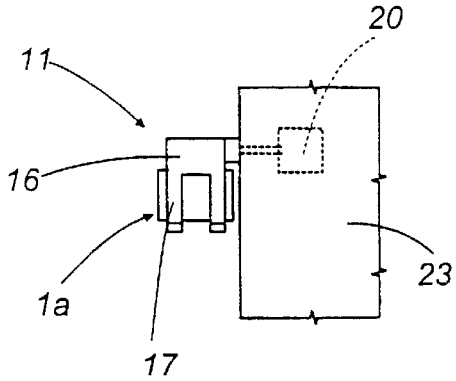
FIG. 5 is a schematic front view, with some parts cut away in order to better illustrate others, of a detail of the device illustrated in FIG. 4.

As shown in FIGS. 3, 4 and 5, said disabling means 11 comprise an element 16, designed to deform a portion 1*a* of the defective filter bag 1 and having a fork-shaped end portion 17 located between the grippers 6*p* and the pair of rollers 19.

The element 16 is rotatably mounted on a frame 23 in the manufacturing machine M and is connected to handling means 20 (illustrated as a block in FIG. 2) which are in turn driven and controlled by the unit 8; said handling means 20 cause the element 16 to move in an oscillating fashion, thereby causing the fork-shaped portion 17 to oscillate, along a substantially arc-shaped path, in the direction indicated by the arrow F17 in FIG. 2, between a non-operative position in which the fork-shaped portion 17 is away from the area Z where the filter bags 1 are released (see FIG. 2) and an operative position in which the portion 17 is designed to strike the upper portion or top edge 1*a* of the filter bag 1 found to be defective by the sensors 7, in such a way that the bag 1 is folded or deformed towards the lower edge of the portion 1*a;* the portion 1*a* protrudes freely from the gripper 6*p* (see FIGS. 3, 4 and 5 and arrow F17). In this way, the defective filter bag 1 cannot be picked up by the rollers 19 and the forward movement of the defective filter bag 1 in the radial direction P towards the sealing station 110 and stacking station 10 is thereby prevented.

Figure 6:
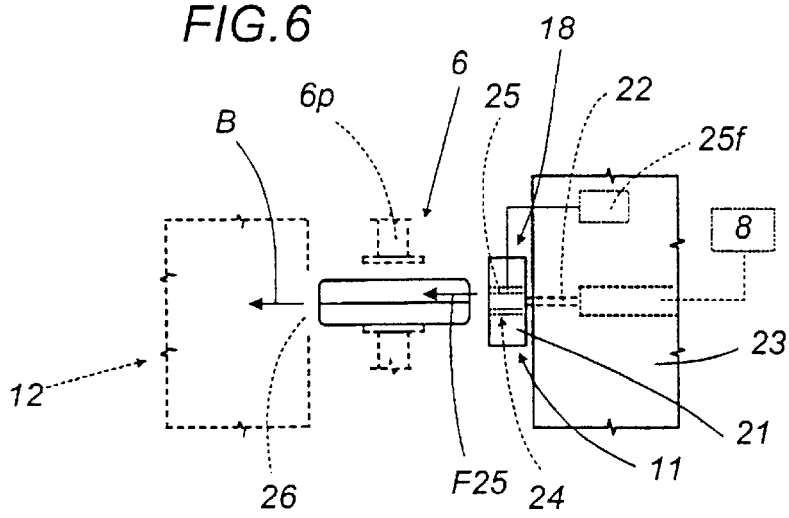
FIG. 6 is a schematic front view, with some parts cut away in order to better illustrate others, of another detail of the device illustrated in FIG. 3.

As illustrated in FIGS. 2, 3 and 6, the disabling means 11 also comprise an element 18 for expelling the defective filter bag 1, mounted and designed to operate downstream from the deforming element 16 along the production line A, controlled by the unit 8, and designed to move the defective filter bag 1, whose portion 1*a* has already been deformed, away from the gripper 6*p* which open as the starwheel 6*r* completes another revolution.

As illustrated in FIG. 6, this expeller element 18 comprises a pusher head 21 which is connected to the end of a shaft 22 mounted on the frame 23 and designed to come into contact with a lateral surface of the defective filter bag 1.

The shaft 22 moves in a reciprocating fashion, driven and controlled by the unit 8 between a non-operative position in which the pusher head 21 is away from the grippers 6*p* and an operative position in which the pusher head 21 is close to the grippers 6*p*, thereby expelling the defective filter bag 1 from the corresponding gripper 6*p* in a direction B transversal to the vertical plane in which the production line A extends and towards said collection means 12 (see FIG. 6 and arrow B).

In order to increase the expelling effect exerted by the pusher head 21 on the defective filter bag 1, the expeller element 18 preferably has means 24 for blowing fluid (air) in direction B.

Looking in detail, these blowing means 24 comprise a pair of through holes 25 made in the pusher head 21 and connected to a pressurised fluid source 25*f* (illustrated schematically by a block) which is directed at the defective filter bag 1 (see arrow F25) as the expeller element 18 moves from the non-operative to the operative position.

As already mentioned, the defective filter bag 1 collection station 12 has a feed opening 26, in the proximity of the expeller element 18.

Thanks to the method described above is adopted and the device 100 that implements it defective filter bags 1 can be rejected individually through simple operations designed to prevent the transfer of the filter bags 1 from the starwheel 6*r* to the pair of rollers 19, and to then expel the defective filter bag 1 from the grippers 6*p* on the starwheel 6*r*.

In this way, individual defective filter bags can be rejected before they reach the stations for stacking and subsequent packing in boxes. The rejection operation is automatic, does not require modification of the basic structure of the manufacturing machine and is carried out according to a method that is rapid, straightforward and effective.

The invention described can be subject to modifications and variations without thereby departing from the scope of the inventive concept. Moreover, all the details of the invention may be substituted by technically equivalent elements.

What is claimed is:

1. A method for rejecting a filter bag for infusion products in a manufacturing machine, the method comprising the steps of:

feeding the filter bag along a production line to a plurality of work stations installed sequentially along the production line, wherein assembly of the filter bag is completed by attaching a connecting string and a pick-up tag to the filter bag;

detecting and inspecting the filter bag during completion of assembly;

feeding the filter bag to an intermediate pick-up station, wherein an end portion of the filter bag is picked up by the intermediate pick-up station and transferred to a subsequent stacking station for forming stacks of a predetermined number of the filter bags;

disabling the feeding of the filter bags to the stacking station when one of the filter bags is determined to be defective during inspection; and rejecting and expelling the defective filter bag, wherein the disabling step comprises deforming the defective filter bag by folding the end portion of the defective filter bag to prevent the defective filter bag out of the reach of the intermediate pick-up station so as from being picked up by the intermediate pick-up station and moved toward the stacking station.

2. The method according to claim 1, wherein the defective filter bag is rejected and expelled in a direction transverse relative to a plane in which the production line extends towards a defective filter bag collection station.

3. A device for rejecting filter bags for infusion products installed in a manufacturing machine, each filter bag comprising at least one chamber that contains a charge of the infusion product, and a string joining the at least one chamber to a pick-up tag connected to the other end of the string; the device comprising:

handling means for moving the filter bags along a production line, wherein the handling means includes a plurality of grippers, each gripper configured to pick-up individual filter bags with an end portion of each filter bag protruding freely from a corresponding gripper;

a station for attaching the string to each filter bag;

a station for attaching the pick-up tag to the string and positioning the string and pick-up tag on each filter bag;

an intermediate pick-up station for picking up the end portion of each filter bag and transferring the filter bag to a stacking station where stacks of a predetermined number of filter bags are formed, wherein each of the stations are sequentially installed along the production line;

a plurality of sensors installed at least in the string and pick-up tag attachment stations for detecting and inspecting each filter bag, wherein any one of the sensors sends an error signal to a control unit if any one of the filter bags is determined to be defective;

means for disabling the forward movement of the defective filter bag, the disabling means being mounted and operating in proximity of the intermediate pick-up station and comprising a deformation element for folding the end portion of the defective filter bag out of the reach of the intermediate pick-up station so as to prevent the defective filter bag from being picked up by the intermediate pick-up station and transferred by the handling means to the stacking station; and means for expelling the defective filter bag from the handling means.

4. The device according to claim 3, wherein the deformation element presents a fork shaped end portion mounted and designed to operate between the handling means and the intermediate pick-up and transfer station.

5. The device according to claim 4, wherein the deformation element comprises a lever supporting the fork-shaped end portion and is rotatably mounted on and connected to an oscillating handling means driven and controlled by the control unit; wherein the oscillating handling means causes the deformation element to move in an oscillating fashion, wherein the fork-shaped portion oscillates between a non-operative position in which the fork-shaped portion is away from an area where the filter bags are released and an operative position in which the fork-shaped portion strikes either one of an upper portion or top edge of the defective filter bag, in a manner wherein the defective filter bag is folded and deformed.

6. The device according to claim 4, wherein the expelling means comprises an expeller element for expelling the defective filter bag and is mounted and designed to operate downstream from the deformation element along the production line and is controlled by the control unit.

7. The device according to claim 6, wherein the expeller element comprises a pusher head connected to an end of a shaft mounted on a frame and, controlled by the control unit, moves between a non-operative position in which the pusher head is away from the handling means and an operative position in which the pusher head is close to the handling means and contacts a lateral surface of the defective filter bag, wherein the defective filter bag is expelled.

8. The device according to claim 7, wherein the expeller element has means for blowing fluid towards the defective filter bag, wherein the blowing means comprises a pair of through holes formed in the pusher head and connected to a pressurized fluid source directed at the lateral surface of the defective filter bag.

9. The device according to claim 8, wherein a collection station is located near the expeller element for collecting defective filter bags expelled from the handling means.

* * * * *